US007014281B2

(12) United States Patent
Wuestefeld et al.

(10) Patent No.: US 7,014,281 B2
(45) Date of Patent: Mar. 21, 2006

(54) FULLY INTEGRATED DISHWASHER DOOR

(75) Inventors: Thomas J. Wuestefeld, Jackson, TN (US); David G. Hartz, Sugartree, TN (US)

(73) Assignee: Maytag Corporation, Newton, IA (US)

( * ) Notice: Subject to any disclaimer, the term of this patent is extended or adjusted under 35 U.S.C. 154(b) by 18 days.

(21) Appl. No.: 10/411,011

(22) Filed: Apr. 10, 2003

(65) Prior Publication Data

US 2004/0201337 A1 Oct. 14, 2004

(51) Int. Cl.
*A47B 76/00* (2006.01)
*A47B 17/04* (2006.01)
*F23M 7/00* (2006.01)

(52) U.S. Cl. ..... 312/204; 312/228; 126/194

(58) Field of Classification Search ..... 312/228, 312/229, 204, 311, 109, 326, 327, 328, 265.6; 134/57 D, 58 D; 126/194
See application file for complete search history.

(56) References Cited

U.S. PATENT DOCUMENTS

| | | | | |
|---|---|---|---|---|
| 2,328,757 | A | | 9/1943 | Tinnerman |
| 2,541,942 | A | * | 2/1951 | Sherman ..... 126/194 |
| 2,776,655 | A | * | 1/1957 | Ferguson, Jr. et al. ..... 126/194 |
| 2,958,911 | A | | 11/1960 | Given et al. |
| D196,982 | S | | 11/1963 | Doman |
| 3,294,461 | A | | 12/1966 | Barnard et al. |
| 3,766,700 | A | | 10/1973 | Nuss |
| 3,773,399 | A | | 11/1973 | Sulcek |
| 3,936,107 | A | | 2/1976 | Gourdeau et al. |
| 4,087,143 | A | | 5/1978 | Barnard et al. |
| 4,229,921 | A | | 10/1980 | Schell |
| 4,478,465 | A | | 10/1984 | Sulcek |
| 4,690,469 | A | | 9/1987 | Grass |
| 4,732,431 | A | | 3/1988 | Mason |
| 4,765,697 | A | | 8/1988 | Gardell et al. |
| 4,900,109 | A | | 2/1990 | Boston, Jr. et al. |
| 4,940,298 | A | * | 7/1990 | Jackson et al. ..... 312/228 |
| D320,489 | S | | 10/1991 | Marks et al. |
| 5,161,343 | A | | 11/1992 | Edwards et al. |
| 5,230,553 | A | * | 7/1993 | Tuller ..... 312/228 |
| 5,365,959 | A | | 11/1994 | Favaro |
| 5,435,641 | A | * | 7/1995 | Dumon Dupuis et al. ..... 312/223.1 |
| 5,466,062 | A | | 11/1995 | McPherson et al. |
| 5,496,104 | A | * | 3/1996 | Arnold et al. ..... 312/204 |
| D377,853 | S | | 2/1997 | Sparks |
| D385,070 | S | | 10/1997 | Hughes et al. |
| D391,695 | S | | 3/1998 | Baldwin et al. |
| 5,806,942 | A | | 9/1998 | Jenkins, Jr. et al. |
| D403,471 | S | | 12/1998 | Brace |
| D425,676 | S | | 5/2000 | Roberts |
| 6,065,820 | A | | 5/2000 | Fleissner et al. |
| D438,352 | S | | 2/2001 | Jeong |
| D438,677 | S | | 3/2001 | Roberts |
| D441,150 | S | | 4/2001 | Bournay, Jr. et al. |

(Continued)

*Primary Examiner*—Peter M. Cuomo
*Assistant Examiner*—Sarah B. McPartlin
(74) *Attorney, Agent, or Firm*—McKee, Voorhees & Sease, P.L.C.

(57) ABSTRACT

A dishwasher door includes an outer panel assembly which is quickly, easily and removably mounted on an inner door assembly. The outer panel assembly includes fasteners with rearwardly extending enlarged heads adapted to extend through key slots in the inner door assembly so as to mount the outer panel assembly onto the inner door assembly. Additional fasteners may be utilized to further secure the outer assembly to the inner assembly. Access to the inner cavity of the door is unnecessary for mounting or removing the outer panel assembly to the inner door assembly.

9 Claims, 8 Drawing Sheets

U.S. PATENT DOCUMENTS

D455,874 S 4/2002 Resuello et al.
D472,023 S 3/2003 Jones et al.
6,536,856 B1 * 3/2003 Pelizzari et al. ..... 312/204
6,736,470 B1 * 5/2004 Manke et al. ..... 312/228

* cited by examiner

FULLY INTEGRATED DISHWASHER DOOR

BACKGROUND OF THE INVENTION

Dishwasher doors typically include a front panel which is mounted to a door frame using fasteners extending forwardly from within the door and into the front panel. An inner door liner covers the fasteners. With such an assembly, the decorative front panel is not intended to be removed. However, some consumers prefer a decorative front panel on their dishwashers that matches other kitchen cabinetry, thus necessitating removal of the manufacturer's front panel.

Accordingly, a primary objective of the present invention is the provision of a dishwasher door having a front panel that can be quickly and easily removed for replacement with a different decorative panel.

Another objective of the present invention is the provision of a dishwasher door having an inner door assembly and an outer panel assembly which can be assembled and disassembled quickly and easily.

A further objective of the present invention is the provision of a front panel assembly for a dishwasher door which is mounted on an inner door assembly using fastener heads on one assembly received in key slots in the other assembly.

Another objective of the present invention is the provision of a method of quickly and easily mounting a front panel assembly to a rear door assembly of a dishwasher door.

These and other objectives will become apparent from the following description of the invention.

SUMMARY OF THE INVENTION

The dishwasher door of the present invention includes an outer panel assembly which is quickly, easily and removably mounted on an inner door assembly. The outer panel assembly has a pair of mounting fasteners extending rearwardly and having an enlarged head for receipt in key slots in the inner door assembly. The inner door assembly includes hinge brackets which define a portion of the key slots. Thus, the outer panel assembly is mounted on the inner door assembly by extending the fastener heads through the key slots and then sliding the panel assembly downwardly to retain the fastener heads in the key slots. Additional fasteners can then be used to further secure the outer panel assembly to the inner door assembly. Preferably, the additional fasteners extend rearwardly through the outer panel assembly from the front surface thereof, and include a head for supporting a door handle.

DETAILED DESCRIPTION OF THE DRAWINGS

Figure 1:
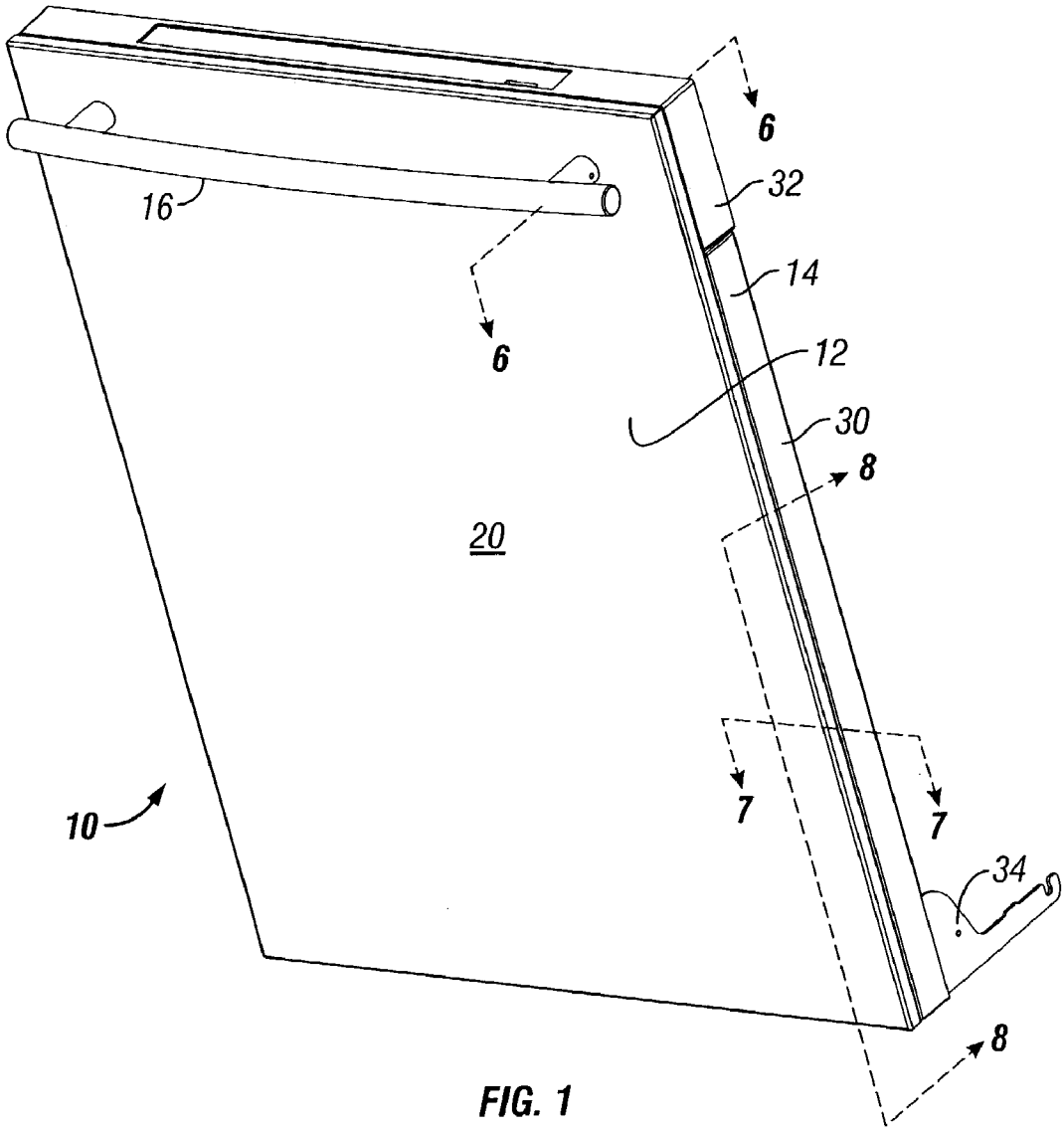
FIG. 1 is a perspective view of the dishwasher door of the present invention.
Figure 2:
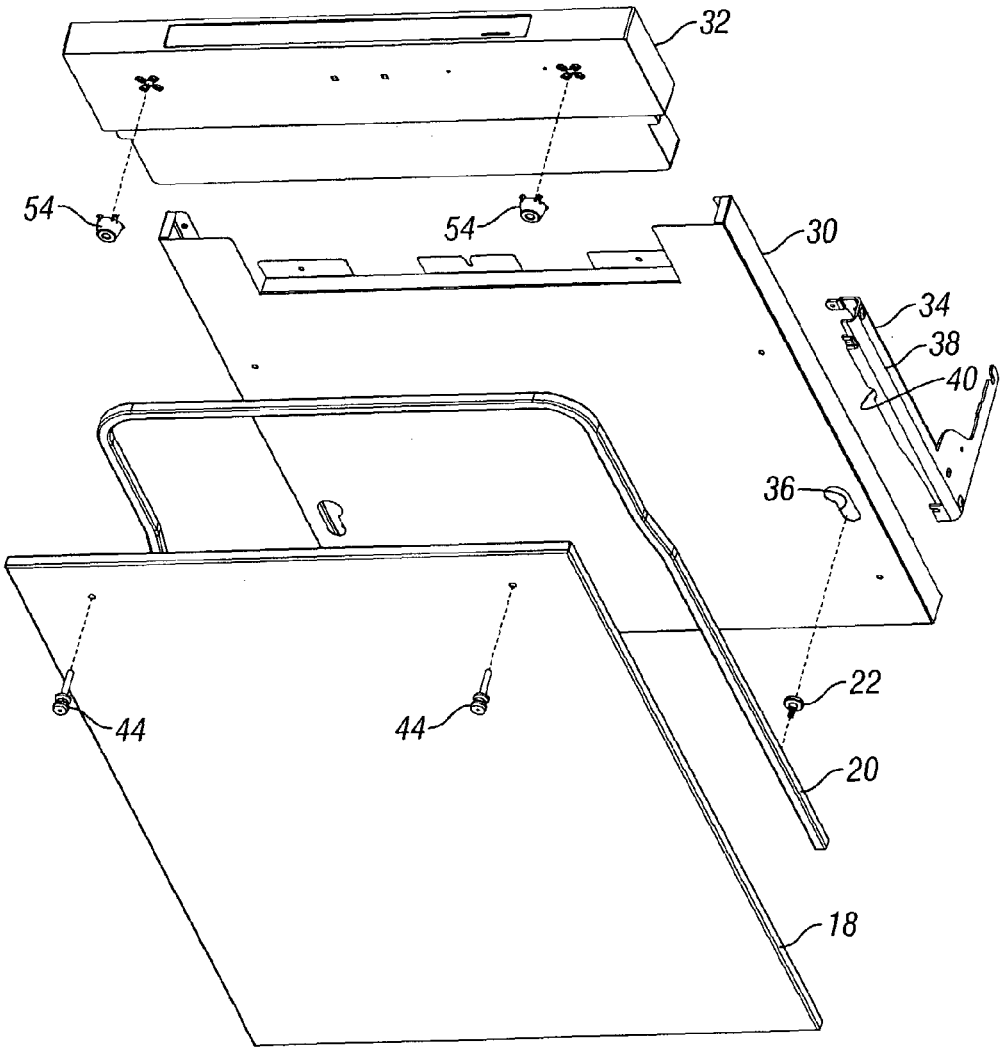
FIG. 2 is an exploded view of the dishwasher door showing the components of the inner door assembly and the outer panel assembly.

The dishwasher door of the present invention is generally designated in the drawings by the reference numeral 10. The door includes an outer panel assembly 12 and an inner door assembly 14. A handle or towel bar 16 is mounted in the outer panel assembly 12, as described in more detail below.

Figure 3:
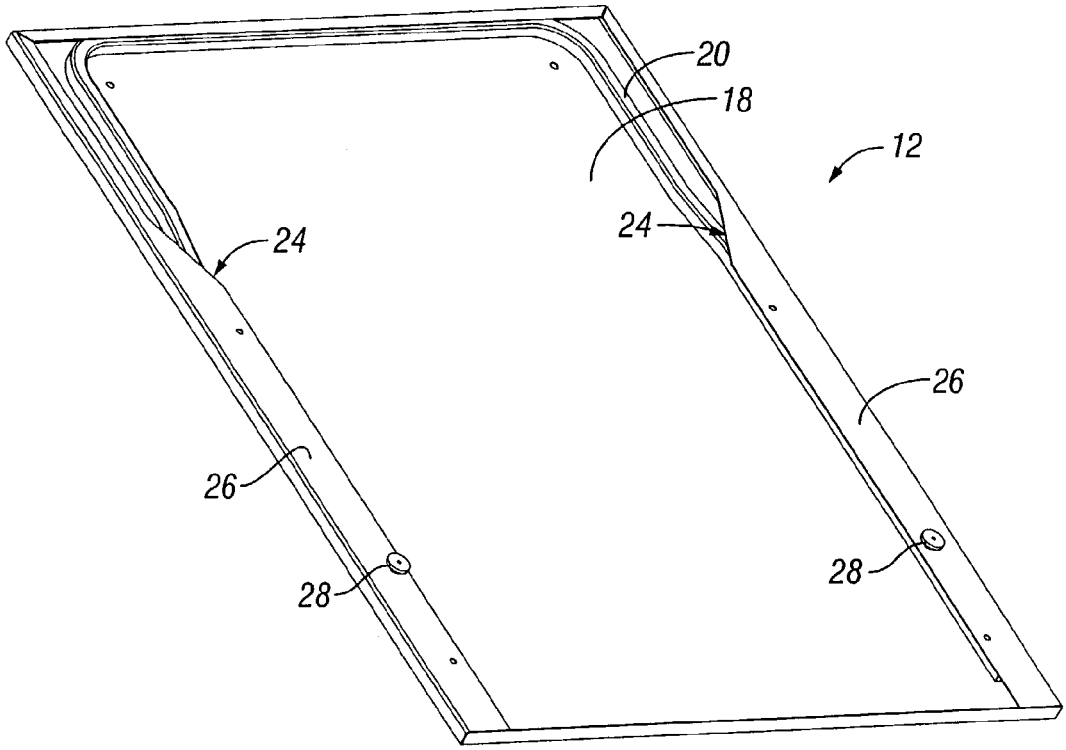
FIG. 3 is a rear perspective view of the outer panel assembly.
Figure 7:
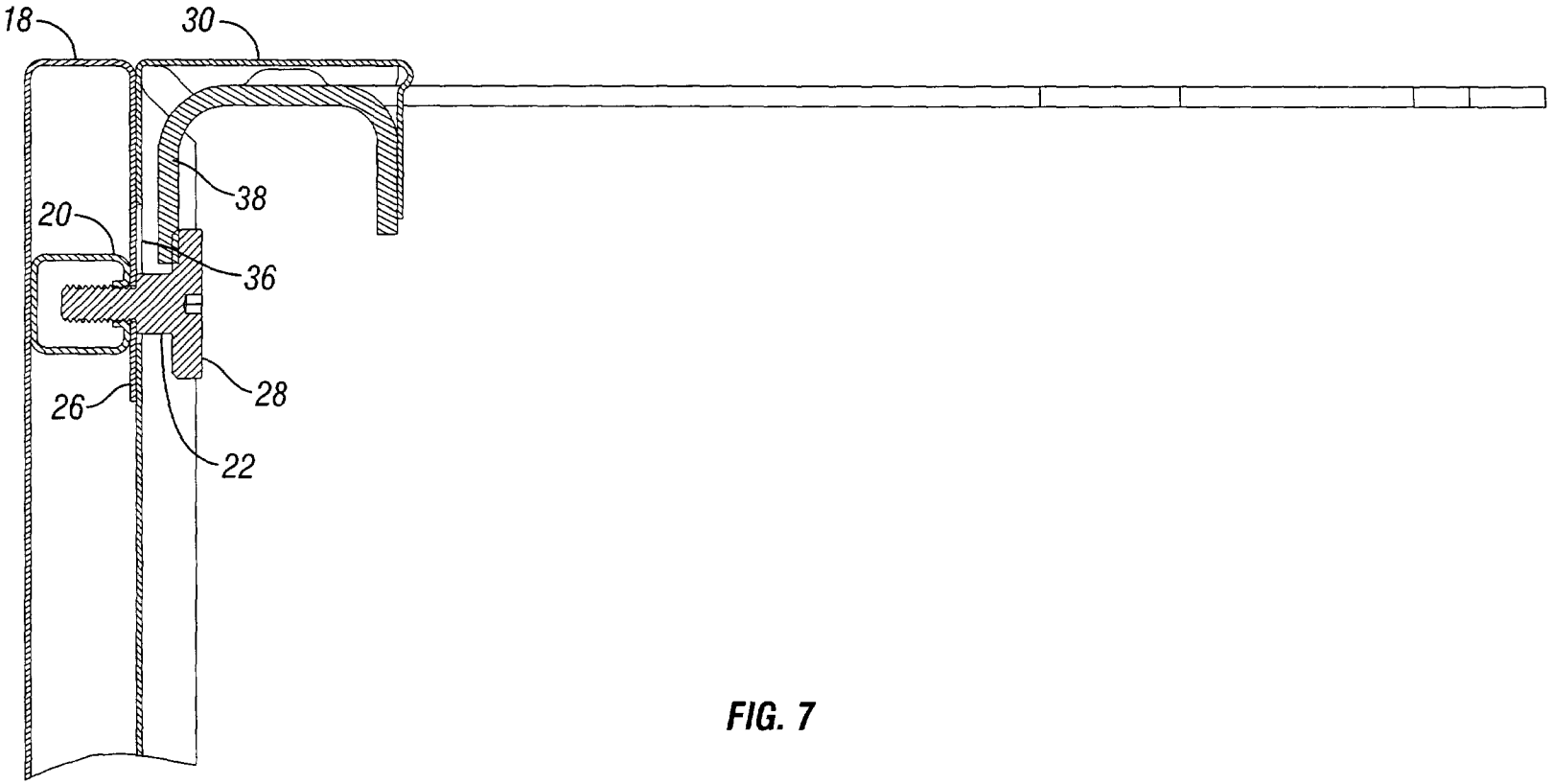
FIG. 7 is a sectional view taken along lines 7—7 of FIG. 1.
Figure 8:
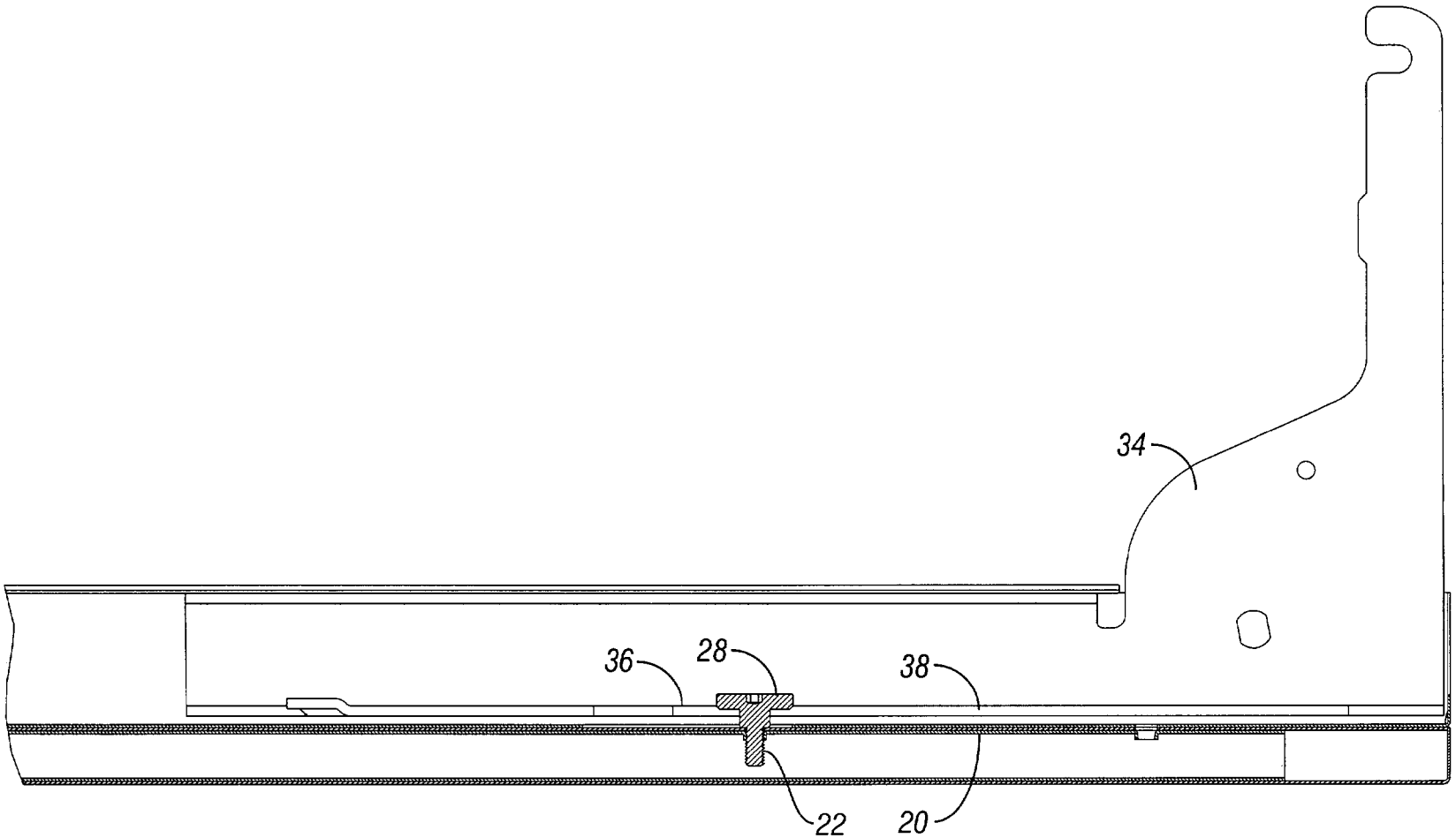
FIG. 8 is a sectional view taken along lines 8—8 of FIG. 1.

The outer panel assembly includes a front panel 18, an inverted U-shaped frame 20, and a first pair of fasteners 22. As best seen in FIG. 3, the frame 20 is received in a channel 24 on the back side of the front panel 18. The channel 24 is defined by inwardly turned flanges or lips 26. The fasteners 22 extend forwardly through the flanges 26 and into the frame 20, as shown in FIGS. 3, 7 and 8 to secure the frame 20 to the panel 18. Each of the fasteners 22 include an enlarged head 26 which is spaced from the flange 26.

The inner door assembly 14 includes a door support 30, a control panel 32 mounted in the upper end of the door support 30, and a pair of hinge brackets 34 connected to the opposite sides of the door support 30 in any convenient manner.

Figure 4:
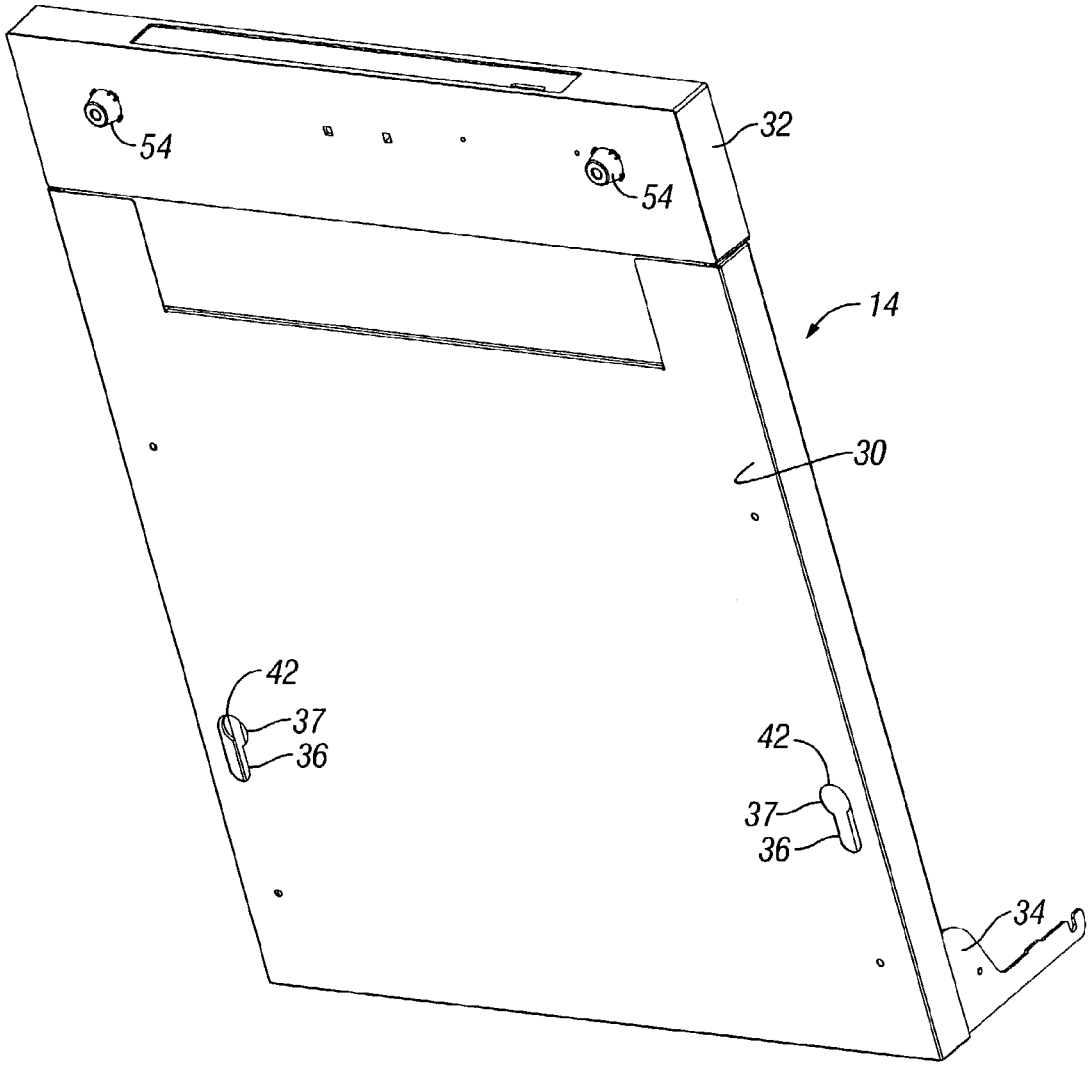
FIG. 4 is a front perspective view of the inner door assembly.
Figure 5:
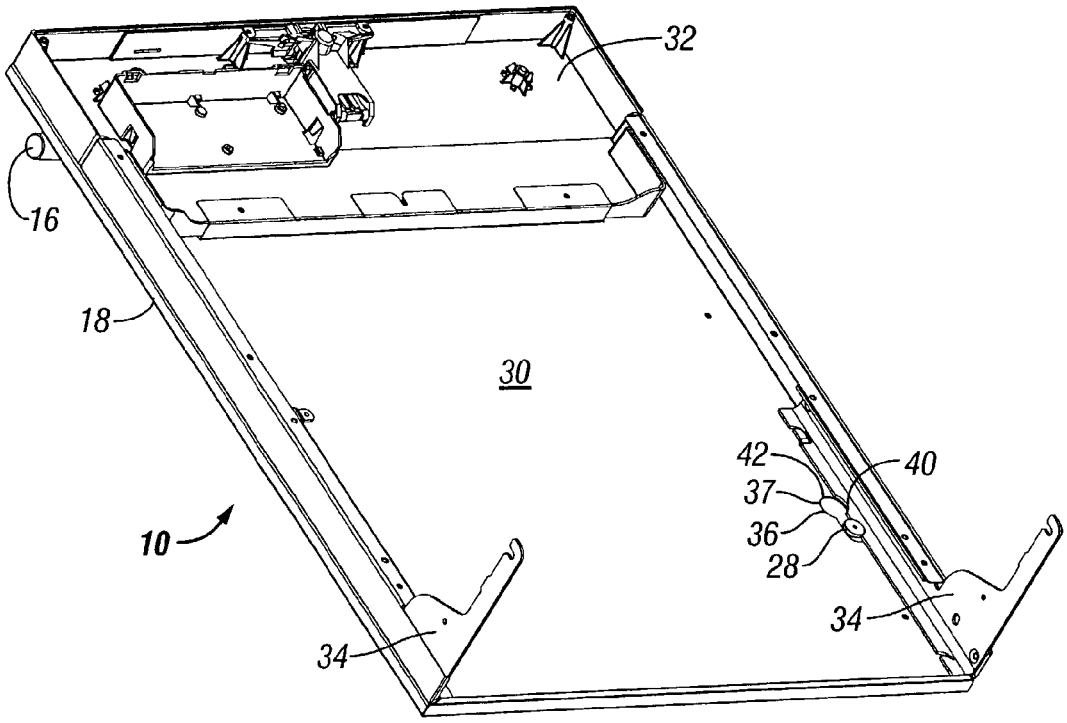
FIG. 5 is a rear perspective view of the dishwasher door.

The door support 30 includes a pair of elongated holes 36, with an enlarged upper end 37 adjacent each side edge of the door support 30. Each hinge bracket 34 includes an upright leg 38 which extends partially into the slot 36 as seen in FIGS. 4 and 5. The leg 38 includes a cut-out portion 40 corresponding to the slot 36 so that the holes 36 and legs 38 define a key slot 42 adjacent opposite side edges of the inner door assembly 14.

Figure 6:
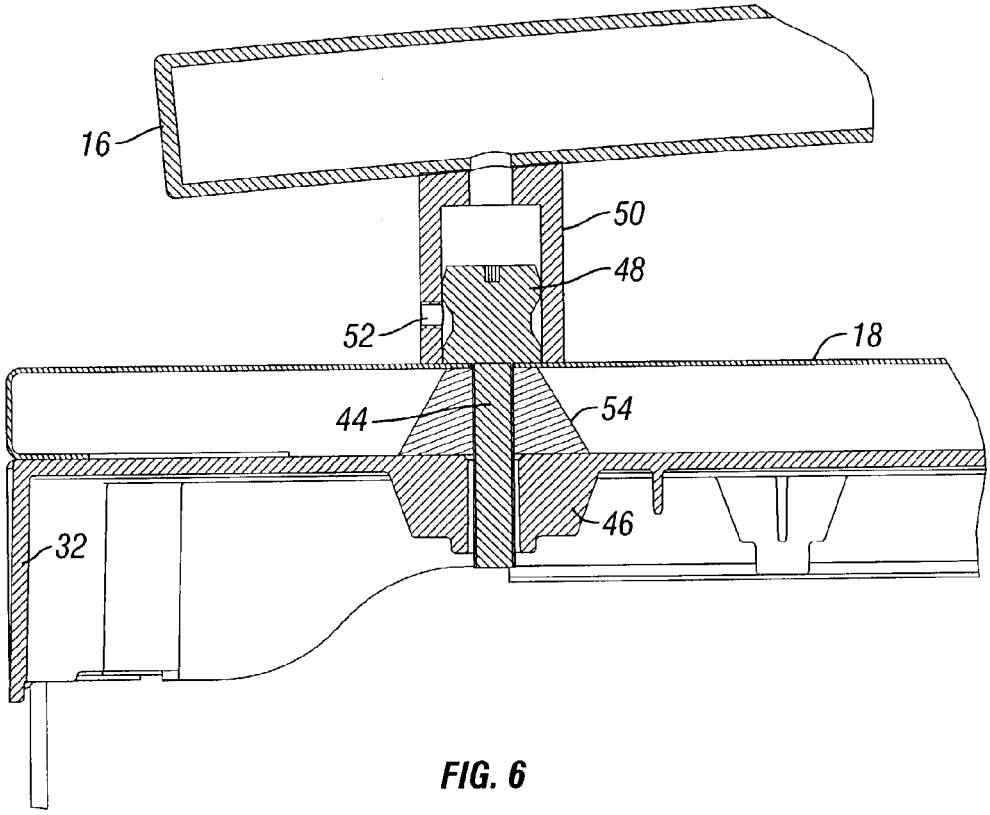
FIG. 6 is a sectional view taken along lines 6—6 of FIG. 1.

The outer panel assembly 12 can be quickly and easily mounted onto the inner door assembly 14, by positioning the panel assembly 12 adjacent the door assembly 14, extending the heads 28 of the fasteners 22 into the enlarged upper ends 37 of the holes 36 in the door support 30, and sliding the outer panel assembly 12 downwardly so that the fastener heads 28 are retained behind the leg 38 of the hinge brackets 34, as best shown in FIGS. 5, 7 and 8. An additional second pair of fasteners 44 can then be extended from the front of the outer panel assembly 12 rearwardly into the inner door assembly to further secure the panel assembly 12 to the door assembly 14. A pair of standoffs 54 may be provided between the front panel 18 and the door support 30, as seen in FIG. 6, for structural rigidity. Preferably, the second fasteners 44 are threadably received in a nut 46 on the inside of the control panel 32. The head 48 of the second fasteners 44 is adapted to receive a mounting post 50 of the door handle 16, as best seen in FIG. 6. The mounting posts 50 are preferably fixed to the fastener heads 48 by a set screw (not shown) extending through a hole 52 in the mounting posts 50.

The front panel 18 may be stainless steel, painted metal, or other suitable material. If a consumer wishes to have a customized front panel to match kitchen cabinetry, the outer panel assembly 12 can be quickly and easily removed from the inner door assembly in three quick and easy steps. First, the set screws in the mounting posts 50 are loosened so that the handle 16 can be removed from the front panel 18. The second fasteners 44 then unthreaded from the inner door assembly door 14. The outer assembly is then raised or slid upwardly such that the heads 28 of the first fasteners 22 are aligned with the enlarged upper ends 37 of the holes 36 and the cut-outs 40 on the hinged brackets legs 38, so that the outer panel assembly 12 can be pulled away from the inner door assembly 14. Thus, there is no need to remove the inner door liner (not shown) of the dishwasher door 10, or to otherwise have access to the interior cavity of the door 10.

It is understood that key slots 42 and fasteners 22 could be reversed on the outer and inner assemblies 12, 14. In other words, the key slots 42 could be in the rear side of the outer panel assembly 12 and the fasteners 22 extending forwardly from the inner door assembly 14, without departing from the scope of the invention.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A dishwasher door, comprising:

an inner door assembly;

an outer panel assembly;

key slots in one of the inner and outer assemblies;

first fasteners in the other of the inner and outer assemblies each having a head for receipt in the key slots so as to removably mount the outer panel assembly to the inner door assembly, wherein the inner door assembly includes a door support and hinge brackets on each side of the door support; and each key slot is defined by a hole in the door support and an edge of the hinge bracket overlapping the hole.

2. The dishwasher door of claim 1 further comprising second fasteners to further secure the assemblies together.

3. The dishwasher door of claim 1 wherein the edge of the hinge bracket includes a cut-out to allow the fastener head to pass behind the hinge bracket.

4. The dishwasher door of claim 1 wherein the inner door assembly includes a control panel.

5. The dishwasher door of claim 1 wherein the panel assembly includes an outer panel and an inner frame, the frame being adjacent a rear surface of the outer panel.

6. The dishwasher door of claim 5 wherein the outer panel has opposite sides each having a channel for receipt of the frame.

7. The dishwasher door of claim 6 wherein the first fasteners extend through the channel and into the frame to secure the frame and outer panel together.

8. The dishwasher door of claim 1 wherein the panel assembly includes a handle mounted to the panel assembly.

9. A dishwasher door, comprising:

an inner door assembly;

an outer panel assembly;

key slots in one of the inner and outer assemblies;

first fasteners in the other of the inner and outer assemblies each having a head for receipt in the key slots so as to removably mount the outer panel assembly to the inner door assembly, wherein the inner door assembly includes a door support and hinge brackets on each side of the door support; and each key slot is defined by a hole in the door support and an edge of the hinge bracket overlapping the hole, wherein each key slot includes an enlarged head portion and a narrowed neck portion.

* * * * *